US006987483B2

(12) United States Patent
Tran

(10) Patent No.: US 6,987,483 B2
(45) Date of Patent: Jan. 17, 2006

(54) EFFECTIVELY BALANCED DIPOLE MICROSTRIP ANTENNA

(75) Inventor: Allen Tran, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 10/371,566

(22) Filed: Feb. 21, 2003

(65) Prior Publication Data

US 2004/0164903 A1 Aug. 26, 2004

(51) Int. Cl.
*H01Q 1/38* (2006.01)
*H01Q 9/28* (2006.01)

(52) U.S. Cl. ..... 343/700 MS; 343/795; 343/821

(58) Field of Classification Search ..... 343/700 MS, 343/795, 821, 859; 333/26
See application file for complete search history.

(56) References Cited

U.S. PATENT DOCUMENTS 3,239,838 A * 3/1966 Kelleher ..... 343/789
4,525,720 A * 6/1985 Corzine et al. ..... 343/895
4,737,797 A * 4/1988 Siwiak et al. ..... 343/859
4,746,925 A * 5/1988 Toriyama ..... 343/713
4,847,626 A * 7/1989 Kahler et al. ..... 343/700 MS
5,892,486 A * 4/1999 Cook et al. ..... 343/795

* cited by examiner

*Primary Examiner*—Michael C. Wilmer

(57) ABSTRACT

A effectively balanced dipole antenna is provided comprising an unbalanced microstrip antenna having a transmission line interface and a planar balun connected to the transmission line interface of the antenna. The balun can be coplanar or multi-planar. For example, a coplanar balun includes an unbalanced coplanar transmission line, with a signal line interposed between a pair of coplanar grounds, and a pair of planar stubs plan-wise adjacent the coplanar grounds. The coplanar grounds are connected to the plane stubs with conductive lines proximate to the antenna transmission line interface. A microstrip planar balun includes an unbalanced microstrip signal line, a microstrip ground formed on the dielectric layer underlying the signal line, and a pair of planar stubs, plan-wise adjacent the microstrip ground. The planar stubs can be located on the same dielectric layer as the signal line or the ground. A stripline planar balun is also provided.

31 Claims, 5 Drawing Sheets

400

EFFECTIVELY BALANCED DIPOLE MICROSTRIP ANTENNA

BACKGROUND OF THE INVENTION

1. Field of the Invention

This invention generally relates to wireless communication antennas and, more particularly, to an effectively balanced dipole, formed from an unbalanced microstrip antenna, and suitable for use in a wireless communications device telephone.

2. Description of the Related Art

The size of portable wireless communications devices, such as telephones, continues to shrink, even as more functionality is added. As a result, the designers must increase the performance of components or device subsystems while reducing their size, or placing these components in less desirable locations. One such critical component is the wireless communications antenna. This antenna may be connected to a telephone transceiver, for example, or a global positioning system (GPS) receiver.

Wireless communications devices, a wireless telephone or laptop computer with a wireless transponder for example, are known to use simple cylindrical coil antennas as either the primary or secondary communication antennas. The resonance frequency of the antenna is responsive to its electrical length, which forms a portion of the operating frequency wavelength. The electrical length of a wireless device helical antenna is often an odd multiple of a quarter-wavelength, such as $3\lambda/4$, $5\lambda/4$, or $\lambda/4$, where $\lambda$ is the wavelength of the operating frequency, and the effective wavelength is responsive to the dielectric constant of the proximate dielectric.

Wireless telephones can operate in a number of different frequency bands. In the US, the cellular band (AMPS), at around 850 megahertz (MHz), and the PCS (Personal Communication System) band, at around 1900 MHz, are used. Other frequency bands include the PCN (Personal Communication Network) at approximately 1800 MHz,
the GSM system (Groupe Speciale Mobile) at approximately 900 MHz, and the JDC (Japanese Digital Cellular) at approximately 800 and 1500 MHz. Other bands of interest are global positioning satellite (GPS) signals at approximately 1575 MHz and Bluetooth at approximately 2400 MHz.

Typically, better communication results are achieved using a whip antenna, as opposed to the above-mentioned helical antennas. Using a wireless telephone as an example, it is typical to use a combination of a helical and a whip antenna. In the standby mode with the whip antenna withdrawn, the wireless device uses the stubby, lower gain helical coil to maintain control channel communications. When a traffic channel is initiated (the phone rings), the user has the option of extending the higher gain whip antenna. Some devices combine the helical and whip antennas. Other devices disconnect the helical antenna when the whip antenna is extended. However, the whip antenna increases the overall form factor of the wireless telephone.

It is known to use a portion of a circuitboard, such as a dc power bus, as an electromagnetic radiator. This solution eliminates the problem of an antenna extending from the chassis body. However, these radiators are extremely inefficient "antennas", typically providing poor gain and directionality. These types of radiators are also susceptible to crosstalk from other signals on the board. Further, these types of radiators can also propagate signals that interfere with digital or radio frequency (RF) on the circuitboard. Electromagnetic communications through these radiators can also be shielded by other circuits, circuit groundplanes, the chassis, or other circuitboards in the chassis.

Regardless of whether the antenna is formed as a helical coil, a whip, or a microstrip (printed circuitboard) antenna, a conventional dipole is fabricated in a balanced configuration. That is, the radiator and counterpoise are 180 degrees out of phase. The balanced transmission line provides the optimal interface for a balanced dipole antenna. However, the typical radio frequency (RF) electrical circuit, including wireless telephones, use unbalanced transmission lines. When an unbalanced transmission line is interfaced with a balanced antenna, a mismatch occurs, as the antenna counterpoise processes a different RF voltage potential than the transmission line ground. As a result, the transmission line ground radiates. Alternately stated, the transmission line ground becomes part of the antenna. This unintentional radiation degrades the intended electromagnetic radiation pattern, and may radiate into other sensitive electrical circuits.

Likewise, when an unbalanced dipole antenna is interfaced with a transmission line, a mismatch occurs. Without an antenna counterpoise, the transmission line ground radiates. Alternately stated, the transmission line ground becomes part of the antenna. This unintentional radiation degrades the intended electromagnetic radiation pattern, and may radiate into other sensitive electrical circuits.

FIG. 10 is a schematic diagram of a balun used for interfacing an unbalanced transmission line to a balanced antenna (prior art). A balanced-to-unbalanced balun is used to minimize RF current in the transmission line ground. The balun induces a current choke at a low impedance point. Alternately stated, a current is induced in the balun that is equal and opposite is phase to the current in the ground. Shown is a so-called bazooka balun that uses $\lambda/4$ decoupling stubs.

Baluns, such as the balun shown in FIG. 10, are typically used with coaxial cable or coax hardlines. Alternately for lower frequency applications, toroidal baluns made with wire can be formed around loaded or unloaded core materials. However, these types of baluns are not practical for use with microstrip transmission lines. Conventionally, when microstrip transmissions lines are interfaced with a balanced antenna, for example in applications where space is critical, the overall electromagnetic performance suffers due to the lack of a balanced-to-unbalanced balun. These same problems also exist with the use of coplanar and stripline transmission lines. Likewise, when a microstrip antenna is fabricated without a counterpoise, when space is a pressing concern for example, and interfaced to a microstrip transmission line, a mismatch will occur.

It would be advantageous if a practical balun could be developed for use in interfacing an unbalanced microstrip, coplanar, or stripline transmission line to an unbalanced microstrip antenna.

SUMMARY OF THE INVENTION

Microstrip, coplanar, and stripline baluns are provided for interfacing unbalanced transmission lines to an unbalanced antenna. These baluns are especially advantageous when the interfacing antenna is a microstrip antenna, so that the transmission line, balun, and antenna can all be formed on the same substrate.

Accordingly, an effectively balanced dipole antenna is provided comprising an unbalanced microstrip antenna having a transmission line interface, and a planar balun connected to the transmission line interface of the antenna. The balun can be coplanar or multi-planar. For example, a coplanar balun includes an unbalanced coplanar transmission line, with a signal line interposed between a pair of coplanar grounds, and a pair of planar stubs plan-wise adjacent the coplanar grounds. The coplanar grounds are connected to the plane stubs with conductive lines proximate to the antenna transmission line interface.

A microstrip planar balun includes an unbalanced microstrip signal line, a microstrip ground formed on the dielectric layer underlying the signal line, and a pair of planar stubs, plan-wise adjacent the microstrip ground. The planar stubs can be located on the same dielectric layer as the signal line or the ground.

A stripline planar balun includes two dielectric layers, an unbalanced stripline signal line between the dielectric layers, stripline grounds formed overlying and underlying the stripline signal line, and a pair of planar stubs formed plan-wise adjacent the stripline signal line.

Additional details of the above-described planar balun and an unbalanced microstrip antenna, that when combined form an effective balanced dipole antenna, are provided below.

DETAILED DESCRIPTION OF THE PREFERRED EMBODIMENTS

Figure 1:
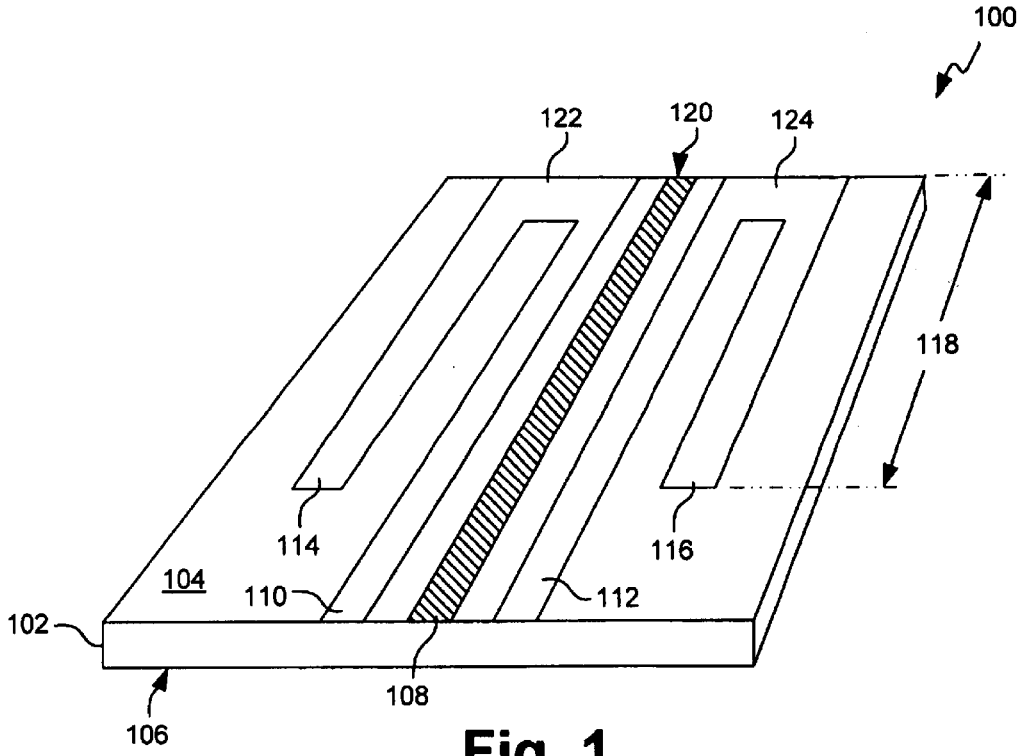
FIG. 1 is a perspective drawing of one aspect of the present invention planar balun.

FIG. 1 is a perspective drawing of one aspect of the present invention planar balun. As explained in more detail below, the planar balun is connected to the transmission line interface of an unbalanced microstrip antenna (not shown is this figure). The combination of planar balun, with the unbalanced microstrip antenna, results in a balanced antenna. That is, the overall result is a balanced antenna, referred to herein as an effectively balanced dipole antenna that minimized transmission line radiation.

More specifically, FIG. 1 depicts a coplanar balun 100. The coplanar balun 100 includes a dielectric layer 102 with a first side 104 and a second side 106 that cannot be seen in this view. An unbalanced coplanar transmission line is shown, with a signal line 108 (cross-hatched lines) interposed between a pair of coplanar grounds 110 and 112, on the dielectric layer first side 104. A pair of planar stubs 114 and 116 is formed in the dielectric layer first side 104. Each stub 114/116 is plan-wise adjacent the coplanar grounds 110 and 112, respectively. As used herein, plan-wise adjacent means that elements are adjacent when viewed from the plan perspective. It should be understood that elements can be plan-wise adjacent when they are located on the same, or different dielectric layer sides. As shown, the coplanar grounds 110/112 are interposed between the planar stubs 114/116 on the dielectric layer first side 104.

The planar stubs 114/116 each have an effective electrical length 118 approximately equal to a quarter-wavelength odd multiple of the antenna operating frequency. That is, a wavelength of $(2n+1)(\lambda/4)$, where $n=0, 1, 2, \ldots$. The length of the stubs 114/116 must be considered in light of the dielectric constant of the circuitboard dielectric layer, as is well known in the art. The antenna interface is depicted with reference designator 120. As shown, the planar stubs 114/116 are lines oriented parallel to the coplanar transmission line (108/110/112). The coplanar grounds 110/112 are connected to the planar stubs 114/116 with conductive lines 122 and 124, respectively, proximate to the antenna transmission line interface 120.

Figure 2A:
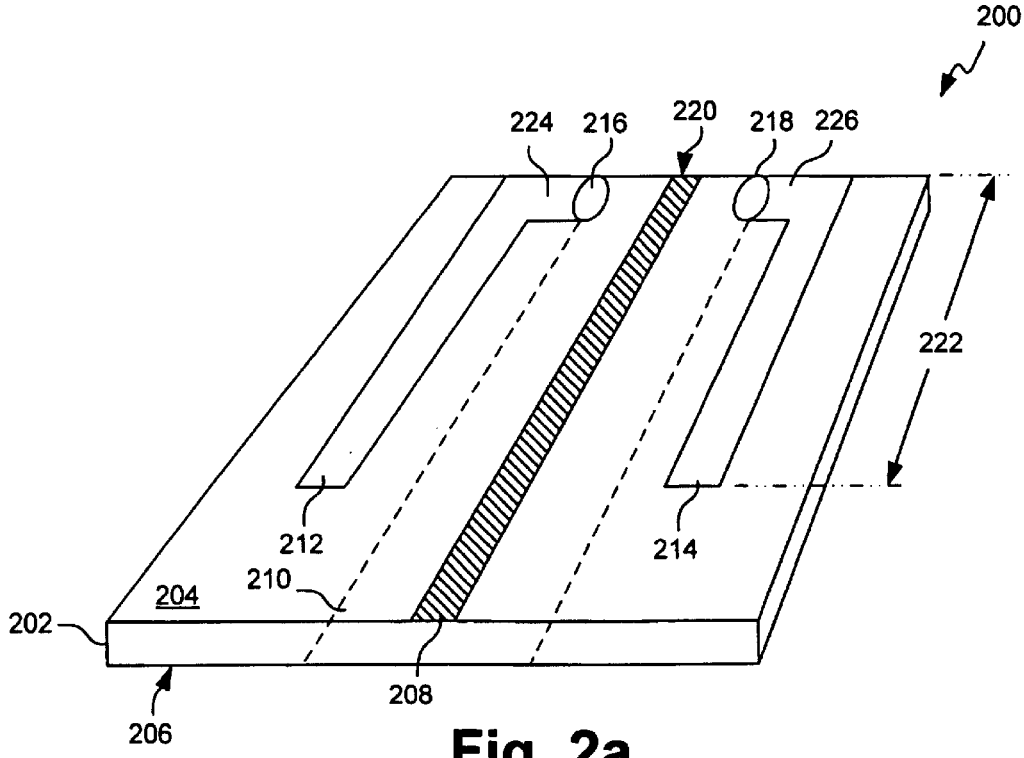
FIGS. 2*a* and 2*b* are perspective drawings featuring a multi-planar aspect of the present invention planar balun.
Figure 2B:
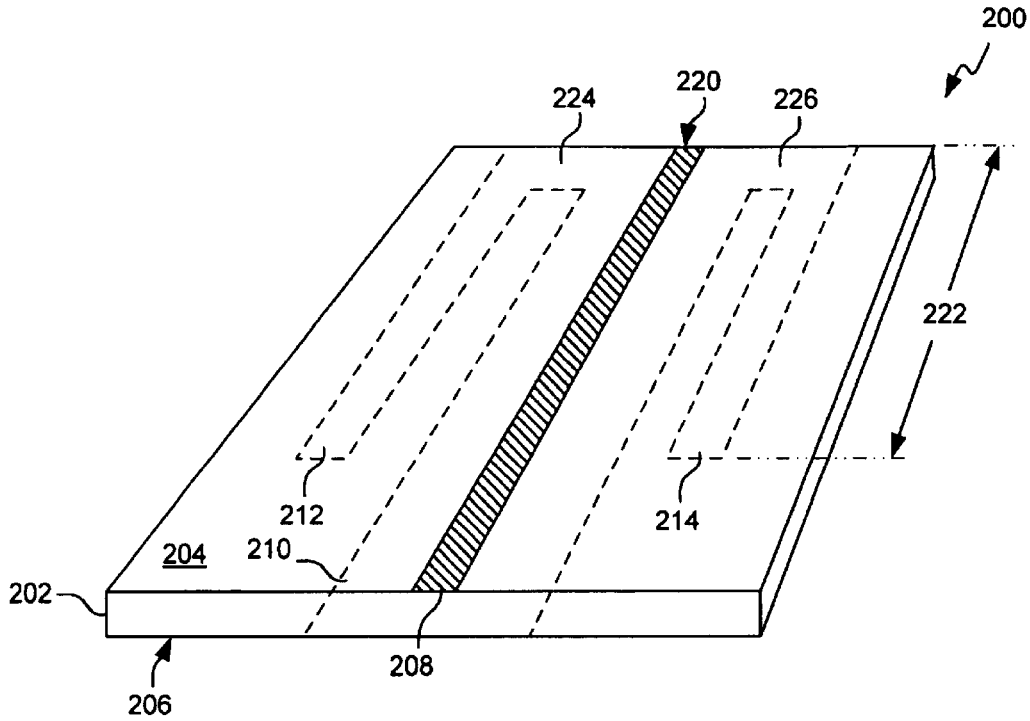

FIGS. 2*a* and 2*b* are perspective drawings featuring a multi-planar aspect of the present invention planar balun. More specifically, the figures depict a microstrip balun. As seen in both figures, the microstrip balun 200 includes a dielectric layer 202 with a first side 204 and a second side 206 that cannot be seen in this view. An unbalanced microstrip signal line 208, depicted with cross-hatched lines, is located on the dielectric layer first side 204. A microstrip ground 210 formed on the dielectric layer second side 206 underlying the signal line 210. The microstrip ground 210 cannot be seen in this view but is depicted with dotted lines. A pair of planar stubs 212 and 214 are plan-wise adjacent the microstrip ground 210.

In FIG. 2*a*, the planar stubs 212/214 are located on the dielectric layer first side 204. The microstrip ground 210 is connected to the planar stubs 212/214 formed on the dielectric layer first side 204 through vias 216 and 218, respectively, located proximate to the antenna transmission line interface 220. Note that the present invention is not limited to any particular number of vias.

In FIG. 2*b*, the planar stubs 212/214 are located on the dielectric layer second side 206 and depicted with dotted lines, as they cannot be seen from this view.

Regarding either FIG. 2*a* or 2*b*, each of the planar stubs 212/214 has an effective electrical length 222 approximately equal to a quarter-wavelength odd multiple of the antenna operating frequency. The planar stubs 212/214 are lines oriented parallel to the microstrip signal line 208.

As seen in FIG. 2*b*, the microstrip ground 210 is connected to the planar stubs 212/214 formed on the dielectric layer second side 206 with conductive lines 224 and 226, respectively, located proximate to the antenna transmission line interface 220. With respect to FIG. 2*a*, although the conductive lines 224 and 226 are shown on the dielectric first side between the vias 216/218 and the stubs 212/214, in other aspects of the invention (not shown) the conductive lines 224/226 are formed on the dielectric second side 206 between the ground 210 and vias 216/218 directly connected to the stubs 212/214.

The microstrip balun 200 of FIGS. 2*a* and 2*b* is shown formed on a dielectric with only two layers for simplicity. However, in other aspects of the invention the microstrip balun can be formed on a dielectric with multiple layers. For example, a dielectric where either digital or radio frequency signal traces are formed in layers intervening between the first side 204 and the second side 206. Alternately, there may be no intervening layers between side 204 and 206, but other dielectric layers may be formed either overlying the first side 204 and/or underlying the second side 206.

Figure 3:
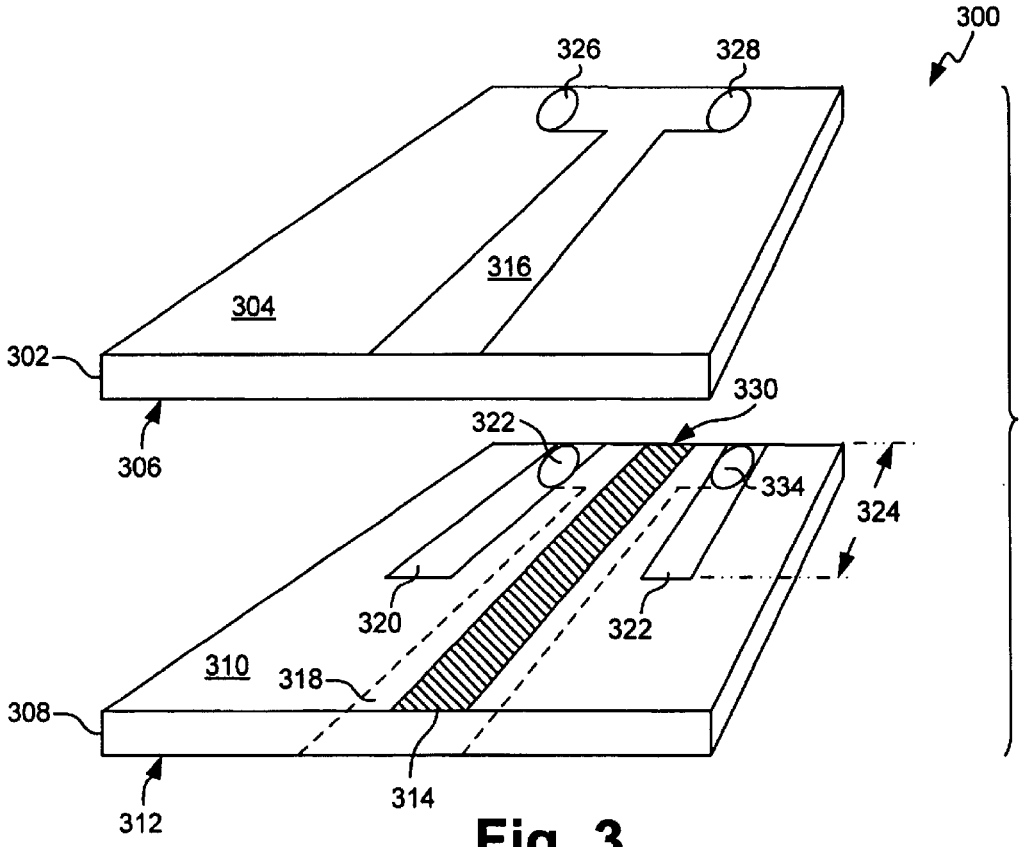
FIG. 3 is a perspective drawing featuring another multi-planar aspect of the present invention planar balun.

FIG. 3 is a perspective drawing featuring another multi-planar aspect of the present invention planar balun. More specifically, the figure depicts an exploded view of a stripline balun. The stripline balun 300 includes a first dielectric layer 302 with a first side 304 and a second side 306 that cannot be seen in this view. A second dielectric layer 308 has a first side 310 and a second side 312 that cannot be seen in this view. An unbalanced stripline signal line 314, depicted with cross-hatched lines, is formed on the second dielectric layer first side 310. Alternately but not shown, the stripline signal line 314 can be formed on the first dielectric layer second side 306. Stripline grounds 316 and 318, respectively, are formed on the first dielectric layer first side 304 overlying the stripline signal line 314 and the second dielectric second side 312 underlying the stripline signal line 314. The stripline ground 318 cannot be seen in this view but is depicted with dotted lines. A pair of planar stubs 320 and 322 are formed between the first dielectric layer second side 304 and the second dielectric layer first side 310, plan-wise adjacent the stripline grounds 316/318, respectively. Note that the planar stubs 320/322 are shown formed on the second dielectric layer first side 310, but they can alternately be formed on the first dielectric second side 306.

The planar stubs 320/322 each have an effective electrical length 324 approximately equal to a quarter-wavelength odd multiple of the antenna operating frequency. The planar stubs 320/322 are lines oriented parallel to the stripline signal line 314. The planar stubs 320/322 are connected to the stripline grounds 316 through vias 326 and 328 located proximate to the antenna transmission line interface 330. Likewise, planar stubs 320/322 are connected to the stripline grounds 318 through vias 332 and 334 located proximate to the antenna transmission line interface 330. Note that although four vias are shown, the present invention is not limited to any particular number of vias. Also note that connecting lines 336, 338, 340, and 342 are used to join the vias 326, 328, 332, and 334, respectively, to grounds 316 and 318. The connecting lines are shown formed on the same dielectric sides as the stripline grounds, but in other aspects of the invention not shown, the connecting lines can be formed in the first dielectric second side 306 and the second dielectric first side 310.

The stripline balun 300 of FIG. 3 is shown formed on a dielectric with only four sides for simplicity. However, in other aspects of the invention the stripline balun can be formed on a dielectric with more layers. For example, a dielectric where either digital or radio frequency signal traces are formed in layers intervening between the first side 304 and the second side 306. Alternately, there may be no intervening layers between side 304 and 306, but other dielectric layers may be formed either overlying the first side 304 and/or underlying the second side 306. A similar analysis applies to sides 310 and 312.

Figure 4:
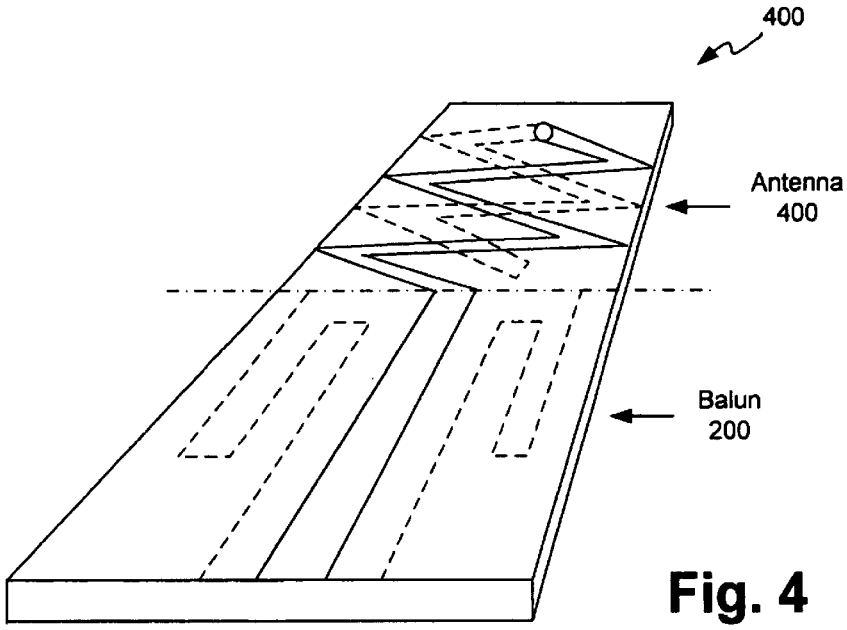
FIG. 4 is a perspective view showing a combination of the present invention planar balun with an unbalanced microstrip antenna.

FIG. 4 is a perspective view showing a combination of the present invention planar balun with an unbalanced microstrip antenna 400. Again, it should be noted that the above-mentioned combination results in an effectively balanced dipole antenna 402. Specifically, a microstrip balun 200 is shown (see FIG. 2*b*) with an unbalanced microstrip antenna 400 having a radiator formed in a zig-zag pattern on two sides of the dielectric layer. Note that the dotted lines represent conductive traces on the dielectric layer underside. Below, are presented many variations of the unbalanced antenna. Although not every combination is specifically depicted, it should be understood that any of the unbalanced microstrip antenna variations can be combined with any of the above-mentioned planar balun designs to form an effectively balanced dipole antenna.

The microstrip antenna 400 is considered to be unbalanced because there is no counterpoise section. The missing counterpoise could be a groundplane, in which case the antenna would be a monopole. Alternately, the missing counterpoise could be another radiator section formed to have an effective electrical length, in which case the antenna would be a dipole. The balun can be considered to be an emulation of a monopole or dipole antenna counterpoise. Hence, the invention is called an effectively balanced dipole antenna. In other aspects, the invention could equally well be called an effectively balanced monopole antenna. The present invention balun could also be considered a choke device that prevents transmission line radiation from occurring when an unbalanced transmission line is interfaced to an unbalanced microstrip antenna.

Figure 5A:
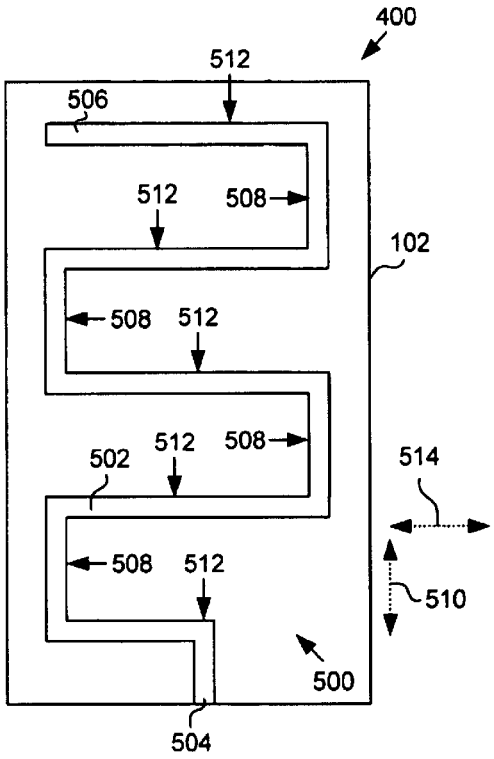
FIGS. 5*a* and 5*b* are plan view details of an unbalanced microstrip antenna.
Figure 5B:
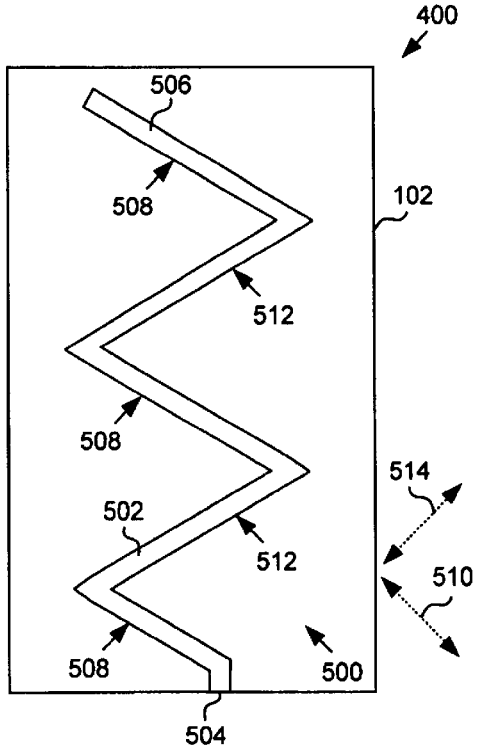

FIGS. 5*a* and 5*b* are plan view details of an unbalanced microstrip antenna. Considering either FIG. 5*a* or 5*b*, the antenna 400 includes a radiator 500 formed from a printed conductive line 502 overlying the circuitboard second portion dielectric layer with a first end 504 for connection to a transmission line and a second, unterminated end 506. The lines can be formed from an etching process that selectively removes portions of a metal cladding overlying the circuitboard. Alternately, the conductive lines can be formed through a metal deposition process.

Typically, the antenna radiator 500 has an effective electrical length of approximately a quarter-wavelength odd multiple at the operating frequency. That is, a wavelength of $(2n+1)(\lambda/4)$, where $n=0, 1, 2, \ldots$. The length of the radiator is a combination of the various meandering sections considered in light of the dielectric constant of the circuitboard dielectric layer, as is well known in the art. In other aspects, the antenna 400 can be different length than a quarter-wavelength odd multiple. Such a situation may occur, for example, when the antenna is expected to operate over a wide bandwidth or multiple bandwidths.

The antenna radiator 500 includes a plurality of first sections 508 with a first orientation 510 and a plurality of second sections 512 oriented with a second orientation 514, that can be orthogonal, or approximately orthogonal to the first orientation 510. When the first and section sections 508/512 are orthogonal, coupling between the sections can be minimized, permitting the antenna to be made "stubby" without substantially degrading the antenna performance. The sections can also be oriented so that they are not orthogonal, further reducing the form factor of the antenna at the expense of performance, which is degraded by increased coupling between radiator first and second sections.

As shown in FIG. 5*a*, the antenna radiator 500 is formed in a pattern of meandering rectangular lines. As shown in FIG. 5*b*, the antenna radiator 400 is shown in a pattern of meandering zig-zag lines. The invention can be enabled with other patterns or shapes, FIGS. 5*a* and 5*b* are merely exemplary.

Figure 6A:
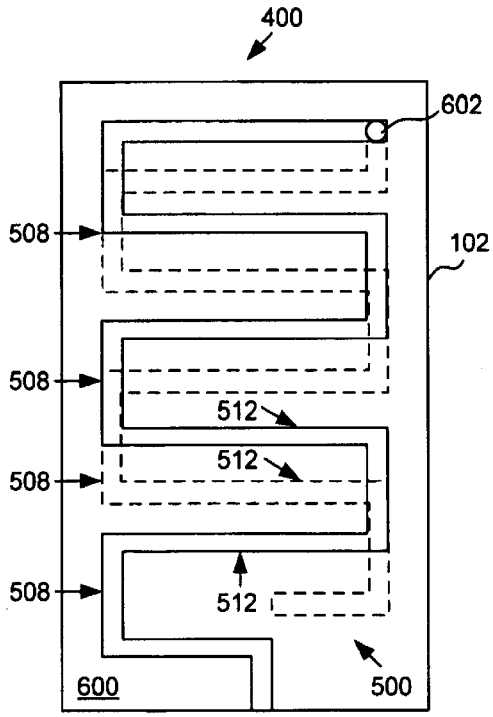
FIGS. 6*a* and 6*b* are plan views illustrating a two-sided circuitboard aspect of the unbalanced microstrip antenna.
Figure 6B:
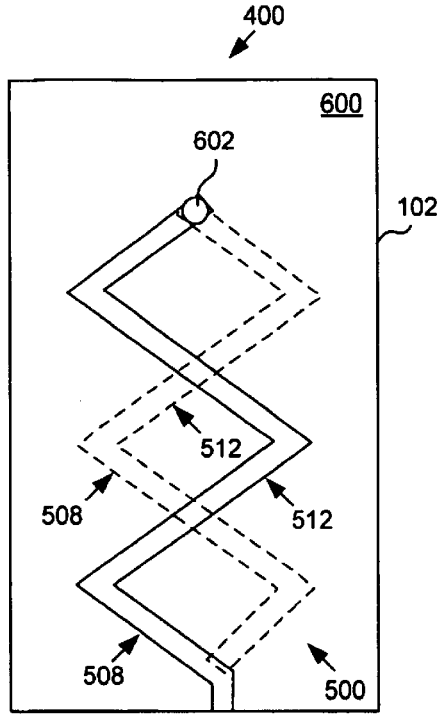

FIGS. 6*a* and 6*b* are plan views illustrating a two-sided circuitboard aspect of the unbalanced microstrip antenna. The circuitboard dielectric layer 102 has a first side 600 that can be seen and a second, opposite side that cannot be seen in the figures. Further, at least one connection via 602 exists between the dielectric layer first side 600 and the dielectric layer second side. The vias can be formed through a process that drills holes through the dielectric and plates the holes with a conductive material. Alternately, the vias can be any means that pass through the dielectric layer to electrically connect to the first and second sides. The antenna radiator 500 includes sections overlying the dielectric layer first side 600 connected to sections on the dielectric layer second side through the via 602. The overall size of the antenna 400 can be reduced by printing the radiator on both sides of the circuitboard.

As shown in FIG. 6*a*, the antenna radiator 500 is formed from a meandering rectangular line overlying the dielectric layer first side 600, and connected through the via 602 to a meandering rectangular line overlying the dielectric layer second side (represented as a dotted line). As shown, the first sections 508 on the circuitboard second side minimally underlie first section 508 on the first side 600 while the second sections 512 on the circuitboard second side minimally underlie second sections 512 on the first side 600. However, other arrangements are possible. For example (not shown), the first sections 508 of the circuitboard second side may underlie the first sections 508 on the circuitboard first side 600. Likewise, the radiator second sections 512 on the circuitboard second side can underlie the second sections 512 on the circuitboard first side 600.

As shown in FIG. 6*b*, the antenna radiator 500 is formed from a meandering zig-zag line overlying the dielectric layer first side 600, and connected through the via 602 to a meandering zig-zag line overlying the dielectric layer second side (represented as a dotted line). As shown, the first sections 508 minimally underlie first section 508 on the first side 600 while the second sections 512 on the circuitboard second side minimally underlie second sections 512 on the first side 600. Alternately but not shown, the first sections 508 of the circuitboard second side may underlie the first sections 508 on the circuitboard first side 600. As another alternate (not shown), the second sections 512 of the circuitboard second side may underlie the second sections 512 on the circuitboard first side 600.

Both figures represent the radiator length to be approximately evenly divided between the dielectric layer first and second sides. However, the lengths need not necessarily be equal. The invention can be enabled with other patterns or shapes, FIGS. 6*a* and 6*b* are merely exemplary.

Figure 7A:
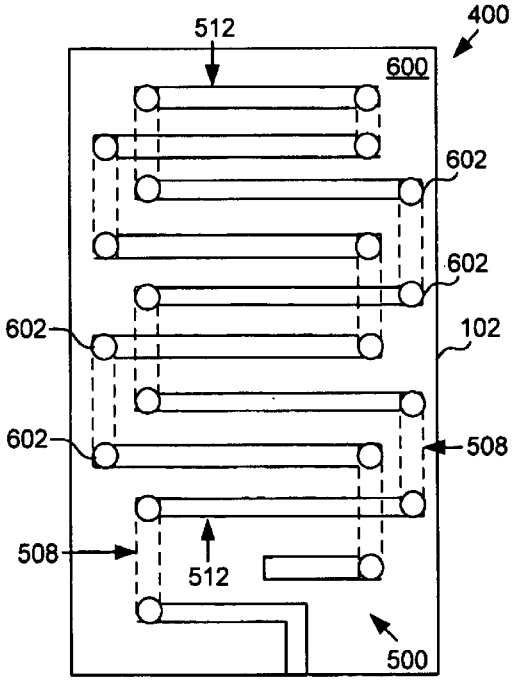
FIGS. 7*a* and 7*b* are plan views illustrating a two-sided circuit aspect of the unbalanced microstrip with side-alternating first and second radiator sections.
Figure 7B:
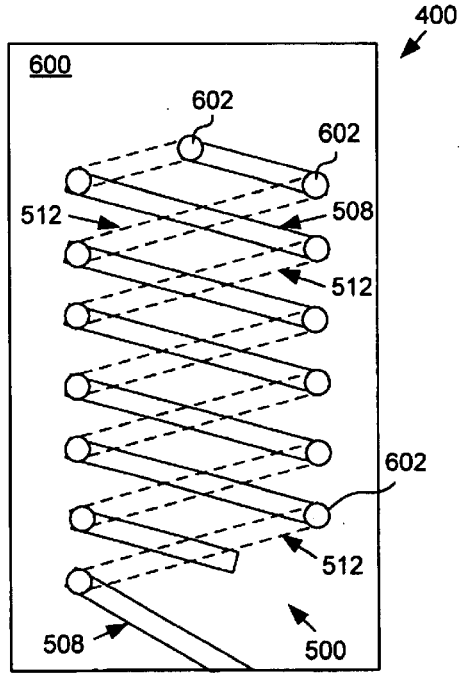

FIGS. 7*a* and 7*b* are plan views illustrating a two-sided circuit aspect of the unbalanced microstrip antenna with side-alternating first and second radiator sections 508/512. The antenna radiator first sections 508 overlie the dielectric layer first side 600 and the radiator second sections 512 overlie the dielectric layer second side. The antenna radiator first and second sections 508/512 are connected with a plurality of vias 602. While not always as space efficient as the antennas of FIGS. 6*a* and 6*b*, the antennas of FIGS. 7*a* and 7*b* promote decoupling between the first and second sections 508/512 by forming them on opposite sides of the circuitboard. In some aspects, as shown in FIG. 7*b*, this increased decoupling permits the first and second sections to be aligned non-orthogonally, to reduce the form factor while minimally impacting the antenna performance.

As shown in FIG. 7*a*, the antenna radiator first sections 508 and second sections 512 (represented as dotted lines) form a meandering rectangular line. As shown in FIG. 7*b*, the antenna radiator first sections 508 and second sections (represented as dotted lines) form a meandering zig-zag line.

Both figures represent the radiator length to be approximately evenly divided between the dielectric layer first and second sides. However, the lengths need not necessarily be equal. The invention can be enabled with other patterns or shapes, FIGS. 7*a* and 7*b* are merely exemplary.

Figure 8A:
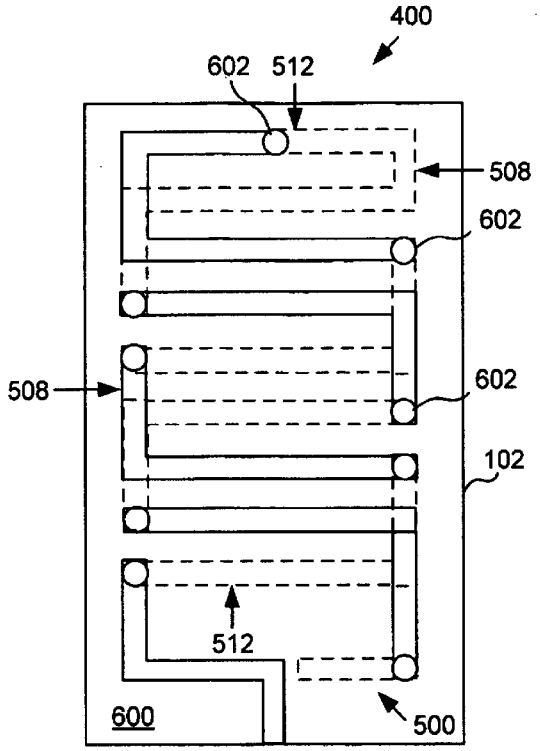
FIGS. 8*a* and 8*b* are plan views illustrating a two-sided circuit aspect of the unbalanced microstrip antenna with side-alternating first and second radiator section combinations.
Figure 8B:
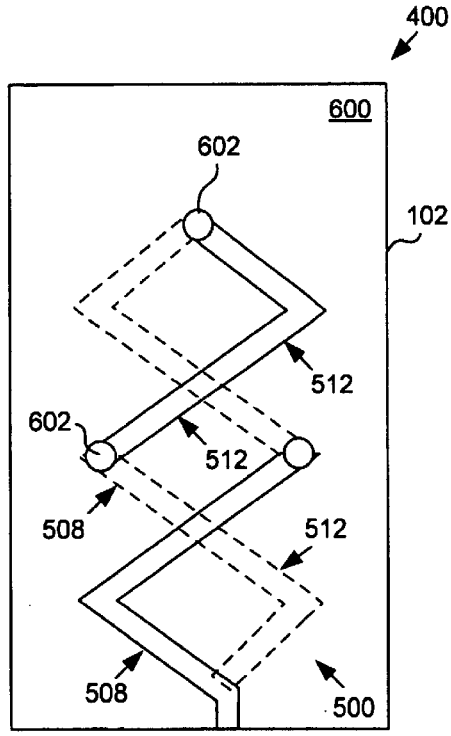

FIGS. 8*a* and 8*b* are plan views illustrating a two-sided circuit aspect of the unbalanced microstrip antenna with side-alternating first and second radiator section combinations. As above, the radiator 500 includes sections overlying the dielectric layer first side connected to sections on the dielectric layer second side through a plurality of vias 602. More specifically, the radiator 500 includes a plurality of first and second section combinations overlying the dielectric layer first side and the radiator includes a plurality of first and second section combinations overlying the dielectric layer second side.

As shown, the combinations each include one first section and one second section, however, the invention is not limited to just this type of combination. The radiator combinations on the dielectric layer first side are connected to the radiator combinations on the dielectric layer second side (shown as dotted lines) with a plurality of vias 602.

In FIG. 8*a*, the antenna radiator first sections 508 and second section 512 combinations form a meandering rectangular line. As shown in FIG. 8*b*, the antenna radiator first sections 508 and second section combinations form a meandering zig-zag line.

Both figures represent the radiator length to be approximately evenly divided between the dielectric layer first and second sides. However, the lengths need not necessarily be equal. The invention can be enabled with other patterns or shapes, FIGS. 8*a* and 8*b* are merely exemplary.

Figure 9:
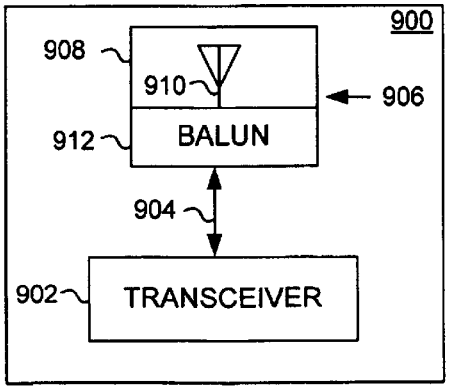
FIG. 9 is a schematic block diagram of the present invention wireless communications telephone system.
Figure 10:
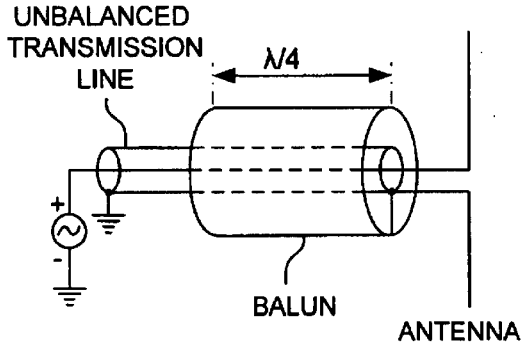
Fig. 10 (PRIOR ART)
FIG. 10 is a schematic diagram of a balun used for interfacing an unbalanced transmission line to a balanced antenna (prior art).

FIG. 9 is a schematic block diagram of the present invention wireless communications telephone system. The system 900 comprises a transceiver 902 with an antenna port on line 904 and an effectively balanced dipole antenna 906. The effectively balanced dipole antenna 906 includes an unbalanced microstrip antenna 908 having a transmission line interface on line 910 and a planar balun 912 having a first port connected to the transmission line interface of the antenna 908 and a second port connected to the transceiver antenna port on line 904. The dipole antenna 908 communicates at one, or more of the following frequencies: 824 to 894 megahertz (MHz), 1850 to 1990 MHz, 1565 to 1585 MHz, and 2400 to 2480 MHz. Detailed descriptions of the balun and antenna are provided in the explanations of FIGS. 1 through 8*b* above.

An effectively balanced dipole antenna has been provided comprising an unbalanced microstrip antenna and a planar balun. Some examples have been given of balun types, antenna types, and balun/antenna combinations. However, other variations and embodiments of the present invention will occur to those skilled in the art.

We claim:

1. An effectively balanced dipole antenna comprising:

an unbalanced microstrip antenna having a transmission line interface;

a planar balun connected to the transmission line interface of the antenna;

wherein the planar balun includes:

a dielectric layer with a first side and a second side;

an unbalanced coplanar transmission line, with a signal line interposed between a pair of coplanar grounds, on the dielectric layer first side; and a pair of planar stubs formed on the dielectric layer first side, plan-wise adjacent the coplanar grounds.

2. The antenna of claim 1 wherein the planar balun is a coplanar balun.

3. The antenna of claim 1 wherein the planar balun is a multi-planar balun.

4. The antenna of claim 1 wherein the coplanar grounds are interposed between the planar stubs on the dielectric layer first side.

5. The antenna of claim 4 wherein the planar stubs each have an effective electrical length approximately equal to a quarter-wavelength odd multiple of the antenna operating frequency.

6. The antenna of claim 4 wherein the planar stubs are lines oriented parallel to the coplanar transmission line.

7. The antenna of claim 6 wherein the coplanar grounds are connected to the planar stubs with conductive lines proximate to the antenna transmission line interface.

8. The antenna of claim 1 wherein the planar balun is a microstrip balun.

9. The antenna of claim 1 wherein the planar balun is a stripline balun.

10. An effectively balanced dipole antenna comprising:

an unbalanced microstrip antenna having a transmission line interface;

a planar balun connected to the transmission line interface of the antenna;

wherein the planar balun includes:

a dielectric layer with a first side and a second side;

an unbalanced microstrip signal line on the dielectric layer first side;

a microstrip ground formed on the dielectric layer second side underlying the signal line;

a pair of planar stubs, plan-wise adjacent the microstrip ground.

11. The antenna of claim 10 wherein the planar stubs are located on the dielectric layer first side.

12. The antenna of claim 10 wherein the planar stubs are located on the dielectric layer second side.

13. The antenna of claim 10 wherein the planar stubs each have an effective electrical length approximately equal to a quarter-wavelength odd multiple of the antenna operating frequency.

14. The antenna of claim 10 wherein the planar stubs are lines oriented parallel to the microstrip signal line.

15. The antenna of claim 14 wherein microstrip ground is connected to the planar stubs with conductive lines located proximate to the antenna transmission line interface.

16. The antenna of claim 14 wherein the microstrip ground is connected to the planar stubs formed on the dielectric layer first side through vias located proximate to the antenna transmission line interface.

17. An effectively balanced dipole antenna comprising:

an unbalanced microstrip antenna having a transmission line interface;

a planar balun connected to the transmission line interface of the antenna;

wherein the planar balun includes:

a first dielectric layer with a first side and a second side;

a second dielectric layer with a first side and a second side;

an unbalanced stripline signal line on the first dielectric layer second side;

stripline grounds formed on the first dielectric layer first side overlying the stripline signal line and the second dielectric second side underlying the stripline signal line; and, a pair of planar stubs formed between the first dielectric layer second side and the second dielectric layer first side, plan-wise adjacent the stripline grounds.

18. The antenna of claim 17 wherein the planar stubs each have an effective electrical length approximately equal to a quarter-wavelength odd multiple of the antenna operating frequency.

19. The antenna of claim 17 wherein the planar stubs are lines oriented parallel to the stripline signal line.

20. The antenna of claim 17 wherein the planar stubs are connected to the stripline grounds through vias located proximate to the antenna transmission line interface.

21. An effectively balanced dipole antenna comprising:

an unbalanced microstrip antenna having a transmission line interface;

a planar balun connected to the transmission line interface of the antenna;

wherein the unbalanced microstrip antenna includes:

a dielectric layer with a first side and a second side; and, a radiator formed from a printed conductive line overlying the dielectric layer with a first end for connection to a transmission line and a second, unterminated end, wherein the radiator includes a plurality of first sections with a first orientation and a plurality of second sections with a second orientation, approximately orthogonal to the first orientation.

22. The antenna of claim 21 wherein the radiator is formed in a pattern selected from the group including meandering rectangular lines and meandering zig-zag lines.

23. The antenna of claim 21 wherein the radiator has an effective electrical length of approximately a quarter-wavelength odd multiple at the operating frequency.

24. An effectively balanced dipole antenna comprising:

an unbalanced microstrip antenna having a transmission line interface;

a planar balun connected to the transmission line interface of the antenna;

wherein the unbalanced microstrip antenna includes:

a dielectric layer with a first side and a second side; and, a radiator formed from a printed conductive line overlying the dielectric layer with a first end for connection to a transmission line and a second, unterminated end;

wherein the dielectric layer has a first side, a second side, and at least one connection via between the dielectric layer first side and the dielectric layer second side; and wherein the radiator includes sections overlying the dielectric layer first side connected to sections on the dielectric layer second side through the via.

25. The antenna of claim 24 wherein the radiator is formed from a meandering rectangular line overlying the dielectric layer first side, and connected through a via to a meandering rectangular line overlying the dielectric layer second side.

26. The antenna of claim 24 wherein the radiator is formed from a meandering zig-zag line overlying the dielectric layer first side, and connected through a via to a meandering zig-zag line overlying the dielectric layer second side.

27. The antenna of claim 24 wherein the radiator includes sections overlying the dielectric layer first side connected to sections on the dielectric layer second side through a plurality of vias.

28. The antenna of claim 27 wherein the radiator includes a plurality of first and second section combinations overlying the dielectric layer first side and the radiator includes a plurality of first and second section combinations overlying the dielectric layer second side; and, wherein the radiator combinations on the dielectric layer first side are connected to the radiator combinations on the dielectric layer second side with a plurality of vias.

29. The antenna of claim 24 wherein the radiator first sections overlie the dielectric layer first side and the radiator second sections overlie the dielectric layer second side; and, wherein the radiator first and second sections are connected with a plurality of vias.

30. The antenna of claim 29 wherein the radiator first and second sections form a meandering rectangular line.

31. The antenna of claim 29 wherein the radiator first and second sections form a meandering zig-zag line.

* * * * *